US006662533B1

(12) United States Patent
Holm et al.

(10) Patent No.: US 6,662,533 B1
(45) Date of Patent: Dec. 16, 2003

(54) METHOD OF SHRINK FILM WRAPPING

(75) Inventors: Leif Holm, Marieholm (SE); Gert Lindström, Blentarp (SE); Olle Westborg, Malmö (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 269 days.

(21) Appl. No.: 09/362,734

(22) Filed: Jul. 29, 1999

(30) Foreign Application Priority Data

Jul. 29, 1998 (SE) ..... 9802642

(51) Int. Cl.[7] ..... B65B 11/00
(52) U.S. Cl. ..... 53/466; 53/228; 53/586
(58) Field of Search ..... 53/466, 586, 228

(56) References Cited

U.S. PATENT DOCUMENTS

| | | | | | |
|---|---|---|---|---|---|
| 615,650 | A | * | 12/1898 | Hargraves | |
| 810,005 | A | * | 1/1906 | Tierney | |
| 1,140,039 | A | * | 5/1915 | Jagenberg | |
| 3,710,536 | A | * | 1/1973 | Lee et al. | 53/24 |
| 4,313,288 | A | * | 2/1982 | Tassi et al. | 53/74 |
| 4,662,148 | A | * | 5/1987 | Nilsson | 53/399 |
| 4,991,376 | A | * | 2/1991 | Backman | 53/399 |
| 5,187,922 | A | * | 2/1993 | Mast | 53/466 |
| 5,383,323 | A | * | 1/1995 | Lewczuk | 53/398 |
| 5,513,478 | A | * | 5/1996 | Abt | 53/118 |
| 5,766,280 | A | * | 6/1998 | Hallqvist et al. | 53/399 |
| 5,954,438 | A | * | 9/1999 | Klien et al. | 400/621 |

FOREIGN PATENT DOCUMENTS

| | | |
|---|---|---|
| DE | 2 311 727 | 9/1974 |
| DE | 26 19 422 | 11/1976 |
| SE | 507 029 | 3/1998 |

* cited by examiner

*Primary Examiner*—Eugene Kim
*Assistant Examiner*—Christopher Harmon
(74) *Attorney, Agent, or Firm*—Burns, Doane, Swecker & Mathis, L.L.P.

(57) ABSTRACT

The present invention relates to a method of shrink film wrapping of one or more objects (15). The method employs two film webs, a first (1) and a second (2). The first film web carries a pre-printed decorative artwork with regularly recurring register maintenance markings. The second film web (2) is blank and carries no register maintenance markings. The two film webs (1, 2) are joined or fused together when the objects (15) are moved in by means of a pusher (16) towards the film webs (1, 2), in one or more rows. A sealing device (18, 19), consisting of an upper (18) and a lower (19) sealing jaw, stretches the film webs (1, 2) around the objects (15) and once seals the film webs (1, 2). During the downward movement of the upper sealing jaw (18), the first film web (1) is held fast by a brake (8). The first film web (1) is held in register in that the first film web (1), during the sealing, is advanced by means of a drive roller (6) for the formation of a loosely hanging loop (21).

4 Claims, 3 Drawing Sheets

METHOD OF SHRINK FILM WRAPPING

TECHNICAL FIELD

Figure 1:
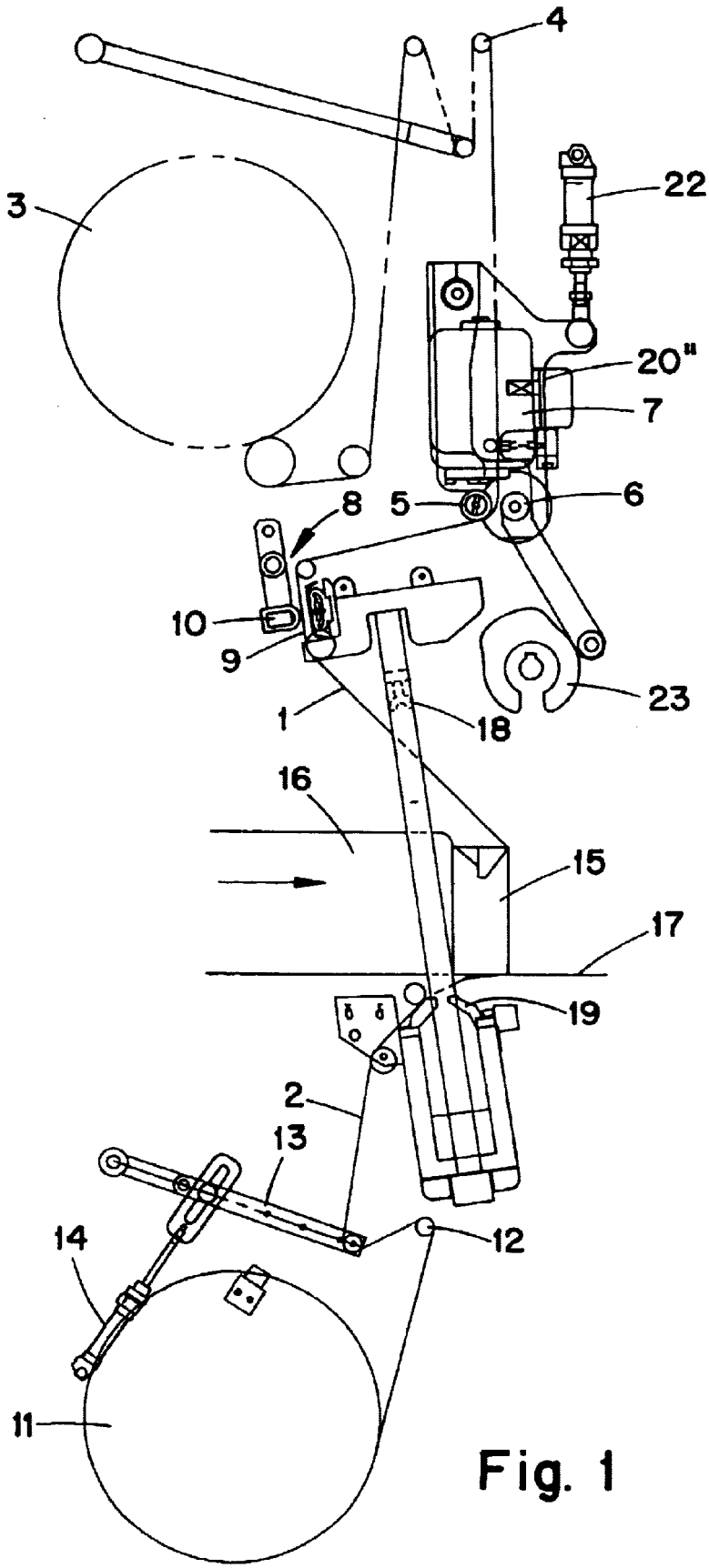

The present invention relates to a method of shrink film wrapping of one or more objects, in which two film webs, a first and a second web, are sealed together by means of a sealing device and in which the objects are moved in towards the sealed film webs with the aid of a pusher in one or more rows, whereafter the film webs are once again sealed together, cut off and caused to surround the objects, the first film web being provided with decorative artwork in register.

BACKGROUND ART

One common method within the packaging industry of making distribution units is to shrink film wrap one or more packages together to form a distribution unit which is attractive to the consumers. It is also becoming increasingly common that these distribution units wrapped with shrink film are given their own, distinctive identity by utilising a film carrying pre-printed decorative artwork.

The commonest method of shrink film wrapping is that the packages are surrounded by one or two film lengths forming a relatively loose bandoleer which, in a subsequent working station, passes a hot air oven where the film bandoleer is inflated by the hot air, whereafter the film is shrunk around the packages. The shrinking often entails that the film becomes creased and punctured during this process. Providing such a shrink film with any form of printing at all has proved to be extremely difficult.

Recently, use has begun to be made of so-called stretch film for wrapping packages into distribution units. As a result of this process, use is made of the stretching properties of the film instead of its ability to shrink when heated. This gives many advantages in that it is possible to utilise a thinner film, material consumption is reduced and, when the intention is to employ pre-printed film, neat and attractive packages will be obtained. An apparatus for shrink film wrapping which utilises such film is disclosed in Swedish Patent Specification SE 507 029. However, this apparatus has suffered from drawbacks when pre-printed film with register maintenance has been employed, since it has proved to be difficult to set and maintain it in register, given that the apparatus for register maintenance has but a very short time at its disposal to compensate for the position of the printed film in relation to the wrapping of the packages.

OBJECTS OF THE INVENTION

One object of the present invention is to realize a method of shrink film wrapping of objects, for example packages, which, in a simple and reliable manner, makes for the use of pre-printed film which is held in register.

A further object of the present invention is that the method gives a sufficiently long time interval for the apparatus to be able to compensate for the position of the film in relation to those packages which are to be surrounded by the film.

SOLUTION

These and other objects have been attained according to the present invention, in that the method of type disclosed by way of introduction has been given the characterizing feature that the first film web is held in register in that the first film web is caused to form a loosely hanging loop before each sealing operation.

Preferred embodiments of the present invention have further been given the characterizing features as set forth in the appended subclaims.

BRIEF DESCRIPTION OF THE ACCOMPANYING DRAWINGS

Figure 2:
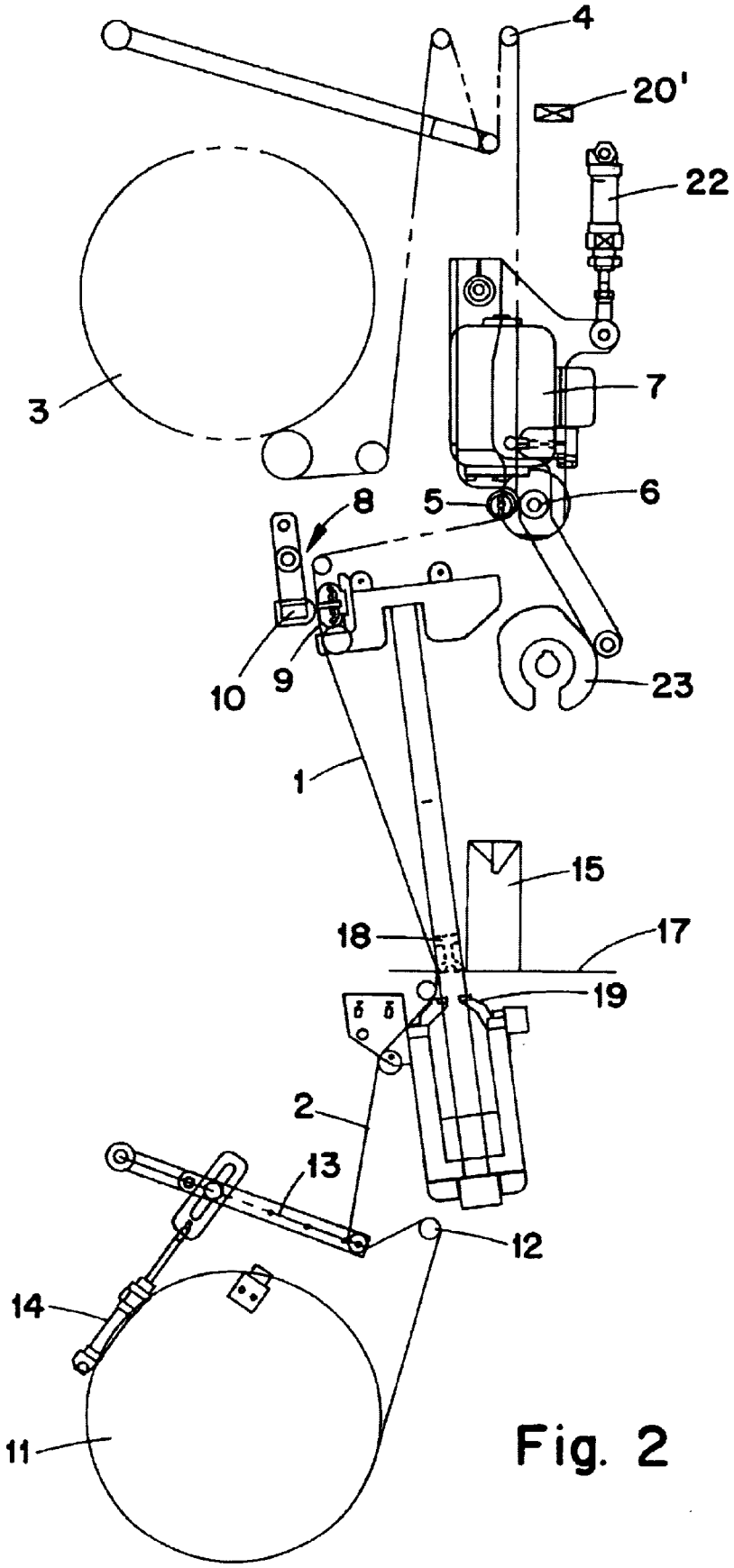
Figure 3:
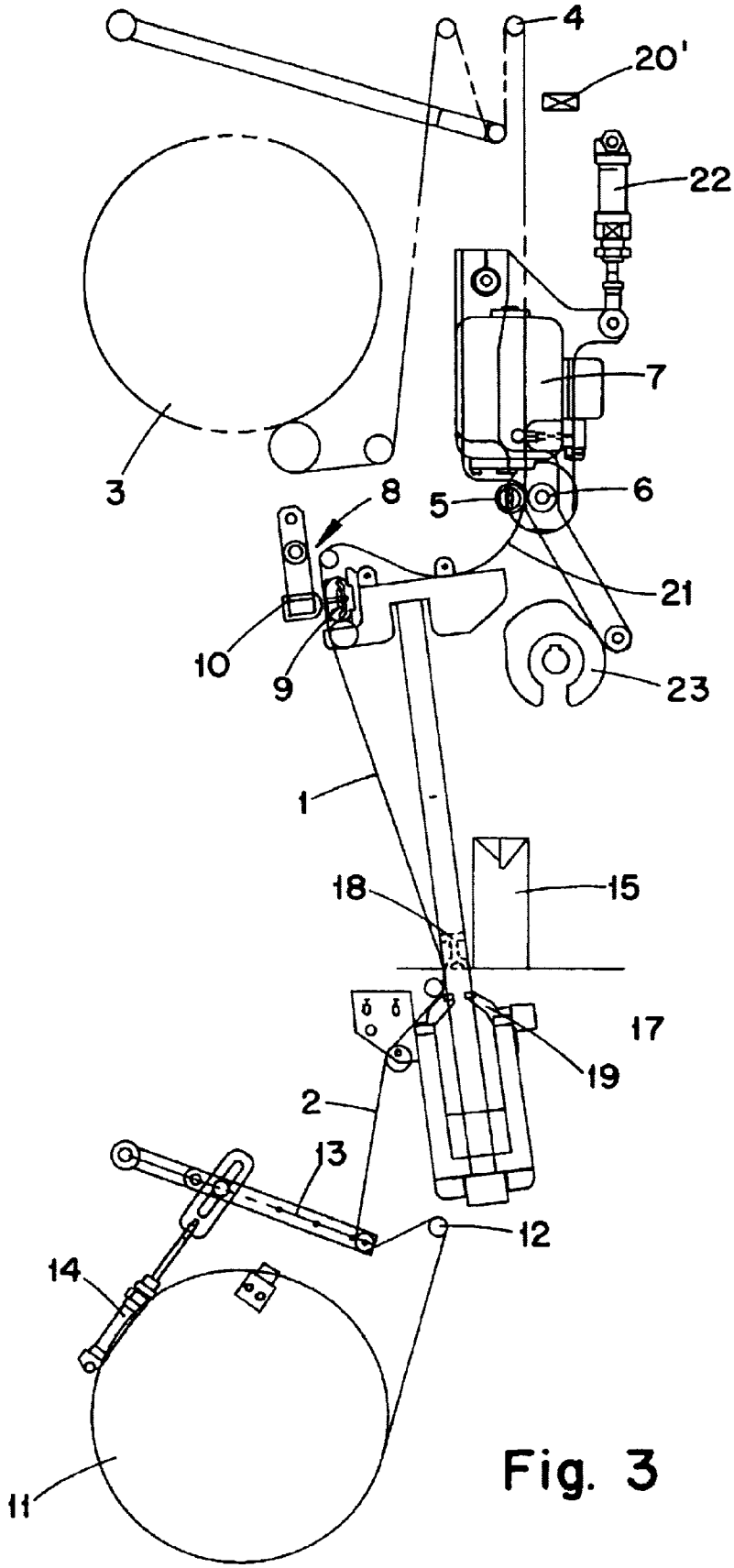

One preferred embodiment of the present invention will now be described in greater detail hereinbelow, with reference to the accompanying Drawings, in which:

FIGS. 1–3 show a sequence of the method in a schematic presentation.

The accompanying Drawings show only those parts and details which are essential to an understanding of the present invention, and the placing of the equipment in its context—which is well known to a person skilled in the art—has been omitted.

DESCRIPTION OF PREFERRED EMBODIMENT

The apparatus for realising a method of shrink film wrapping according to the present invention is apparent from appended FIGS. 1–3. The apparatus utilises two film webs, a first web 1 and a second web 2. The two films webs 1 and 2 together constitute the film which surrounds the objects which are to be shrink film wrapped. The film webs 1 and 2 are so-called stretch films of, for example, polyethylene.

The first film web 1, which may also be designated the upper film web, is provided with pre-printed decorative artwork with regularly recurring register markings. The first film web 1 comes from a driven magazine reel 3. Via a number of bending rollers 4, the first film web 1 passes a drive roller 6 and a counter roller 5. The drive roller 6 is driven by an electric motor 7. In its turn, the electric motor 7 is controlled by a piston and cylinder assembly 22 and a cam 23. Before the first film web 1 reaches the drive roller 6, it passes a photocell 20', 20". The photocell 20', 20" is movable between two positions. A read-off position and a rest position.

Thereafter, the first film web 1 passes a brake 8. The brake 8 may, for example, consist of a conventional hose brake. The hose brake has a portion 9 which expands with the aid of compressed air when the brake 8 is activated and urges the film web 1 against a block 10. The first film web 1 converges with the second film web 2 at that point where the objects which are to be shrink film wrapped are fed into the apparatus.

The second film web 2, which may also be designated the lower film web, comes from a driven magazine reel 11 and passes a number of bending rollers 12. By the intermediary of a linkage 13, at least one of the bending rollers 12 is biased by means of a pneumatic piston and cylinder assembly 14. After an additional number of bending rollers 12, the second film web 2 converges with the first film web 1. The second film web 2 carries no pre-printed decorative artwork and no register markings.

The objects which are to be shrink film wrapped enter the apparatus on a conveyor which is not shown on the Drawings. The objects consist of packages 15, for example liquid packages of the single-use disposable type which may have a parallelepipedic appearance, or alternatively display the configuration of a prism. By means of a conventional brake (not shown) placed on the infeed conveyor, the packages are marshalled or grouped into the desired packing pattern. A pusher 16 moves in the packages 15 in one or more rows depending upon the packing pattern. The packages 15 are moved into the apparatus on a number of slide rails 17. The slide rails 17 are placed where the first film web 12 meets the second film web 2.

Where the film webs 1 and 2 converge, there is also provided a sealing device consisting of an upper sealing jaw 18 and a lower sealing jaw 19. The sealing jaws 18 and 19 seal together the two film webs 1 and 2. The sealing forms two parallel, long and narrow sealing surfaces and there is provided in the lower sealing jaw 19 a knife which is disposed to cut off the sealed film webs 1 and 2 centrally between the two sealing surfaces. Alternatively, the films 1 and 2 are cut off before the sealing operation and are held in position by the jaws 18 and 19. This is to avoid tension in the film webs 1 and 2.

FIG. 1 shows how the pusher 16 moves the packages 15 into the apparatus, to the position where the last packages 15 in the packing pattern have just passed the sealing jaws 18 and 19. The two film webs 1 and 2 are fused or sealed together before the packages 15 are moved in. On infeed, the packages 15 entrain the film webs 1 and 2. Suitably, a top support for the packages 15 should be employed (not shown) so that they do not run the risk of falling and so that they keep together in their packing pattern.

Once the packages 15 have been moved into the apparatus, the upper sealing jaw 18 moves down so as to seal together the film webs 1 and 2. In such instance, the upper sealing jaw 18 will stretch the first film web 1 so that it lies closely adjacent the packages 15. The stretching is further enhanced in that the brake 8 is activated towards the end of the downward movement of the sealing jaw 18.

FIG. 2 shows the apparatus in the sealing position. The brake 8 has been activated and the photocell 20' is in the read-off position. The drive roller 6 moves in towards the counter roller 5 and the electric motor 7 starts in order to advance the film in the first film web 1. When a register marking on the film web 1 is read-off by the photocell 20', the photocell 20' emits a signal to the electric motor 7 which stops. In order to obtain a rapid and distinct stoppage, the motor 7 may be provided with a dynamic brake. Since the brake 8 is activated and holds the film web 1 fast during the advancement by the motor 7 of the film web 1, the first film web 1 will form a loosely handing bight or loop 21 between the brake 8 and the drive roller 6 (see FIG. 3). Alternatively, the brake 8 may be deactivated immediately before the drive roller 6 begins to advance the first film web 1, since the first film web 1 is, in this position, already held fast by the upper sealing jaw 18.

When the sealing is completed and cooled, the upper sealing jaw 18 returns to its upper position. The brake 8 is deactivated and the loosely hanging loop 21 which has been formed in the first film web 1 will fall down. Since the film web 1 is of slight weight, and since it may readily be affected by the ambient environment, such as product spillage and the like, the piston and cylinder assembly 14 is activated and, with the aid of the linkage 13, draws down the web 1 if it cannot fall of its own accord. In the fall, the second film web 2 is also entrained, since it is fused together with the first web 1. The webs 1 and 2 are kept taut by means of the linkage 13 and the piston and cylinder assembly 14. As a result, the joint between the webs 1 and 2 will lie under the slide rails 17. As a result, the first joint of the distribution unit is obtained under the packages 15, which gives a neater unit.

The apparatus is now in position to receive new packages 15, and the first film web 1 lies in register. The drive roller 6 is moved away from the counter roller 5 and the photocell 20 is moved down to the rest position. The photocell 20" has a rest position, since the packages, when they are moved into the apparatus, cause a powerful jolt in the film web 1, which causes the register marking to bounce. If the register marking bounces in front of the photocell 20, a double read-off of the marking will be obtained and the register maintenance function is disabled. In FIG. 1, the photocell 20" is seen in the rest position. If the register read-off were to be incorrect, as for example if the photocell 20" reads-off a register marking in the rest position or during its movement from rest position to read-off position, the apparatus may compensate for this in that the motor 7 feeds the film web 1 in the reverse direction towards the magazine reel 3. When new packages 15 have reached the apparatus, the cycle begins again and the new packages 15 are surrounded by the film webs 1 and 2.

When the packages 15 leave the apparatus, they are surrounded by a bandoleer of the fused together film webs 1 and 2 stretched around the packages 15. Since the film is normally somewhat wider than the total width of the packages 15 in the packing pattern, the film will project somewhat out on each side of the distribution unit. By causing the unit to pass hot air nozzles (not shown) placed on either side of the unit, projecting portions of the film will be shrunk towards the side surfaces of the unit. After cooling of the shrunk side surfaces, the distribution unit is ready for distribution or for further packaging into larger units.

As will have been apparent from the foregoing description, the present invention realises a method of shrink film wrapping, for example of packages, in which use is made of a film with pre-printed decorative artwork which is kept in register. The method results in neat packages in which the utilization of the stretch properties of the film gives an attractive surface with a printed decorative artwork which is fully readable. Further, the method affords simple and reliable register maintenance, in that the apparatus has ample time to correct the position of the pre-printed film.

What is claimed is:

1. A method of shrink film wrapping of one or more objects, comprising the steps of:

sealing together a first and second web of film by means of a sealing device and in which the objects are moved in towards the sealed film webs with the aid of a pusher thereby forming a first seal;

whereafter the film webs are once again sealed together forming a second seal, cut off and caused to surround the objects, the first film web being provided with decorative artwork in register; and holding the first film web in by forming a loosely hanging loop before each sealing operation.

2. The method as claimed in claim 1, wherein the first film web is held fast by a brake while a drive roller, which abuts against a counter roller, advances the film web for the formation of the loosely hanging loop.

3. The method as claimed in claim 2, wherein the loosely hanging loop is formed between the brake and the drive roller.

4. The method as claimed in claim 2, wherein advancement of the drive roller is controlled by a photocell which reads-off register markings on the decorative artwork of the first film web.

* * * * *